United States Patent [19]

Wallin et al.

[11] 3,995,539

[45] Dec. 7, 1976

[54] APPARATUS FOR ERECTING CARTONS

[75] Inventors: Kay Arne Wallin; Bengt Anders Ewjen; Jan Ingemar Nilsson, all of Halmstad, Sweden

[73] Assignee: Sprinter Pack AB, Halmstad, Sweden

[22] Filed: Dec. 19, 1974

[21] Appl. No.: 534,366

Related U.S. Application Data

[63] Continuation-in-part of Ser. No. 359,449, May 11, 1973, Pat. No. 3,893,380.

[52] U.S. Cl. ..... 93/51 HW; 93/49 R

[51] Int. Cl.[2] ..... B31B 1/46

[58] Field of Search ..... 93/49 R, 51 R, 51 HW, 93/59 CE, 59 PL

[56] References Cited

UNITED STATES PATENTS

| | | | |
|---|---|---|---|
| 2,189,105 | 2/1940 | Evans et al. | 93/51 R |
| 3,065,679 | 11/1962 | Clement | 93/51 HW |

*Primary Examiner*—Roy Lake
*Assistant Examiner*—Neil Abrams

[57] ABSTRACT

Method and apparatus for erecting carton blanks having preformed fold lines in which flat carton blanks are pressed into a pair of hollow forming shafts by a plunger assembly of complementary configuration to form hingedly connected lid and tray portions.

The plunger assembly comprises a pair of movable plunger members which undergo synchronized translational and rotational movement and in cooperation with a swingable plate to erect hingedly connected sidewalls of the tray and lid portions. When the side panels of the lid and tray portions of the carton are erected, they are held by the plunger assembly against stationary bottom portions of the shafts. Finger assemblies undergo rotational and reciprocating motion to fold glue bearing edge flaps of the lid and tray portion into their assembled position to maintain associated side panels in their erected position to enable the glued portions to "set". A novel carton blank which is provided with "biasing tabs" is also described.

10 Claims, 34 Drawing Figures

APPARATUS FOR ERECTING CARTONS

This application is a continuation-in-part of application Ser. No. 359,449 filed May 11, 1973 now U.S. Pat. No. 3,893,380 issued July 8, 1975.

BACKGROUND OF THE INVENTION

This invention relates to methods and apparatus for erecting a carton from a flat carton blank. Primarily, the invention relates to the erection of cartons which are comprised of a bottom part in the form of a tray and a lid part in the form of a further tray which is hingedly connected to the bottom part and fits outside its side walls when closing the carton. More particularly, the invention relates to the erection of such bottom trays and lid trays which at two opposite side panels are provided with edge flaps which are to be folded down against the interior surfaces of the side panels and are secured thereto by means of gluing.

It is previously known to erect the carton blanks under consideration by pressing them down into two adjacent shafts by means of a plunger. At the upper ends of the shafts are provided means for folding the side panels of the trays to their erected position and which folds the corner portions between the ends of the side panels. In a certain position within the shafts the carton has been erected and its various portions have been secured to one another by means of glue or other bonding means. The bonding means may be comprised of a heat sealable layer on the blank or it may consist of glud lines or "beads" which are applied to the blank just before it is pressed down into the shafts. When in the shaft the carton in its erected position will be subjected to the action of pressure members which during a predetermined interval act upon these parts of the carton which are to be connected with one another through gluing. According to the known methods and machines the carton will thereafter be subjected to a continued displacement downwardly to the open bottom end of the shaft where the carton is delivered to a conveyor device.

In the known machines the carton is merely guided by the plunger and the walls of the shaft. This means that the bottom of the carton will be free to move when the pressure members act on the carton by engaging the portions of the carton to be glued. However, in practice it has been found that the various portions of the carton become displaced relative to one another in an undesirable manner so that these portions in the ready-made carton will not be located in their correct positions in relation to one another. This displacement of the carton portions in relation to one another is obtained due to the fact that the portions of the carton to be secured to each other will not be kept securely in their proper positions when they are acted on by means of the pressure members at the places to be glued.

BRIEF DESCRIPTION OF THE FIGURES AND OBJECTS OF THE INVENTION

One object of the invention is to provide a method and apparatus which assures that the carton portions under consideration are maintained in their proper positions in relation to each other when the carton is acted on by pressure members at the positions to be glued.

Another object of the invention is to provide a method and a machine which in relation to known machines will enable the plunger mechanism to be moved through a shorter travel upon its reciprocal movement in order to enable an increased working capacity.

These and other objects of the invention will appear from the following description of an embodiment of the machine according to the invention shown by way of example in the accompanying drawings, in which:

FIG. 1 is a perspective view of a blank intended to be erected to a carton having a bottom tray and a lid tray which is hingedly connected with one edge of the bottom tray;

FIG. 1*a* is a diagrammatic perspective view of the carton of FIG. 1 as nearly fully erected;

FIGS. 2*a*, 2*b* and 2*c* are plan, plan and perspective views of another carton blank embodiment respectively in the flat, flat folded and nearly fully erected stages;

Figure 12:
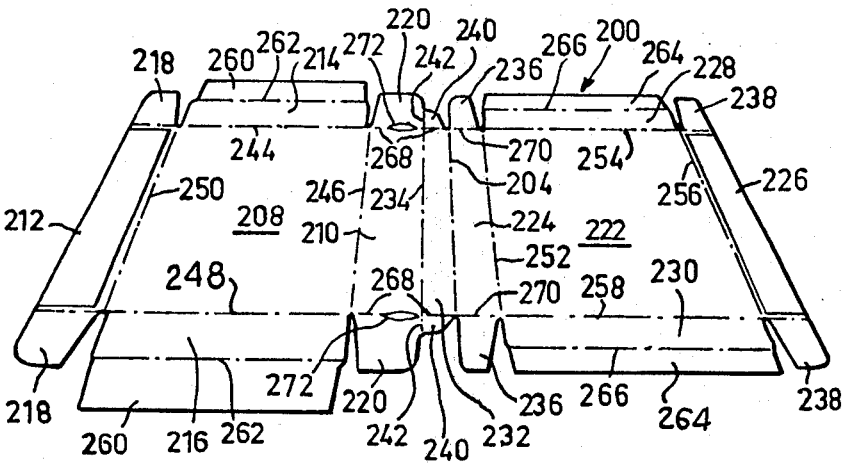
FIG. 12 is a diagrammatic perspective top view of another blank of the general type under consideration to be erected in a second embodiment of the machine according to the invention shown in FIG. 29, to form a carton having relatively short side panels of the bottom tray and of the lid tray respectively.
Figure 12A:
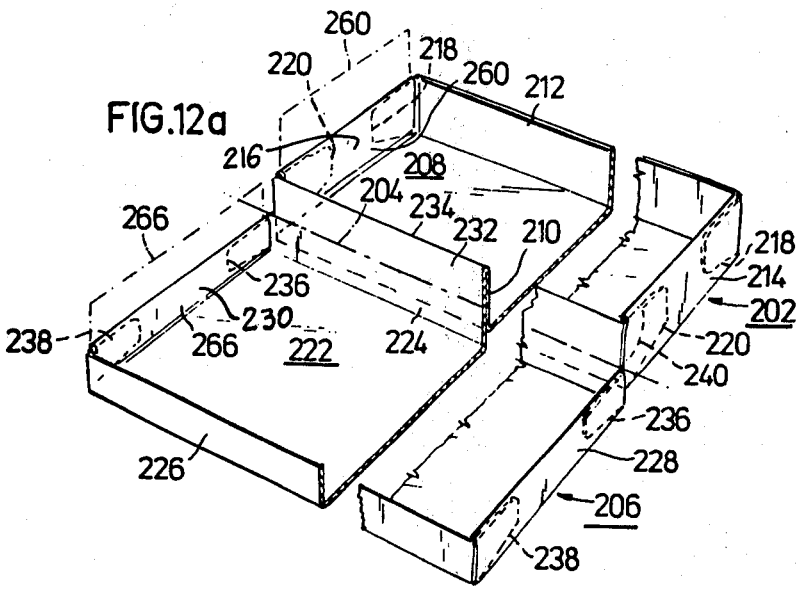
Figure 12B:
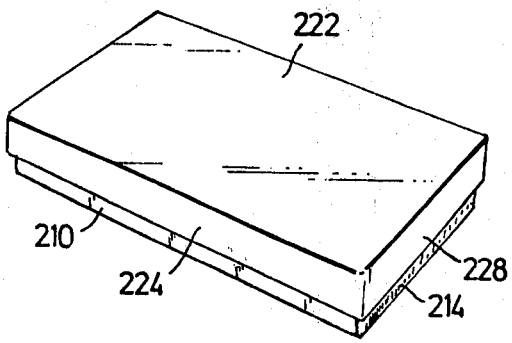
Figure 13:
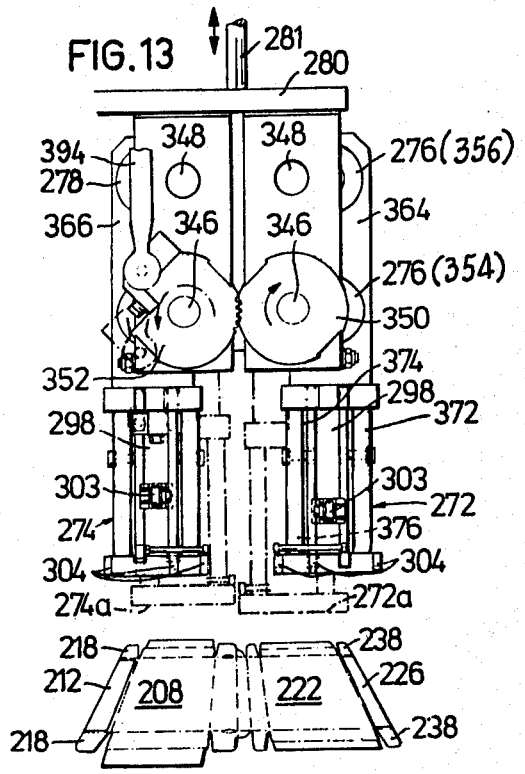
Figure 13:
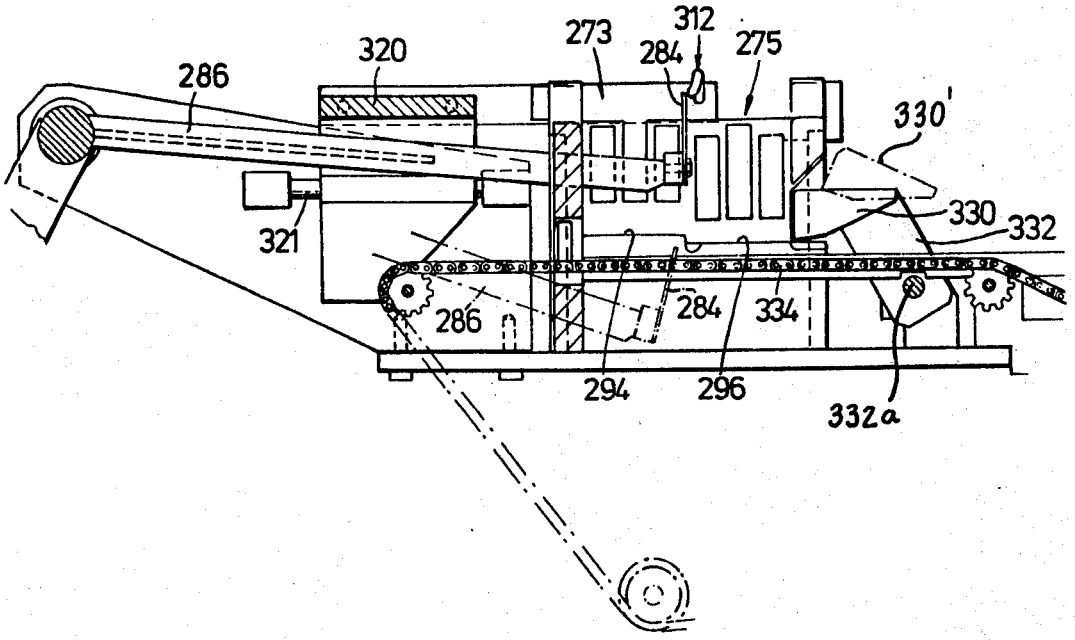
Figure 14:
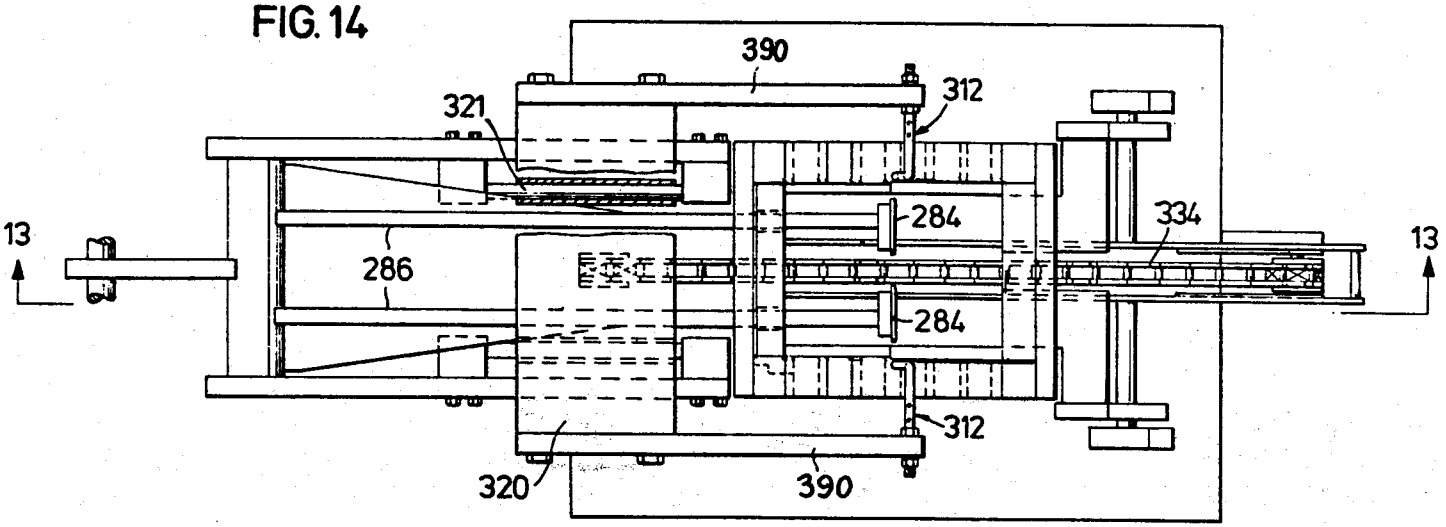
Figure 15:
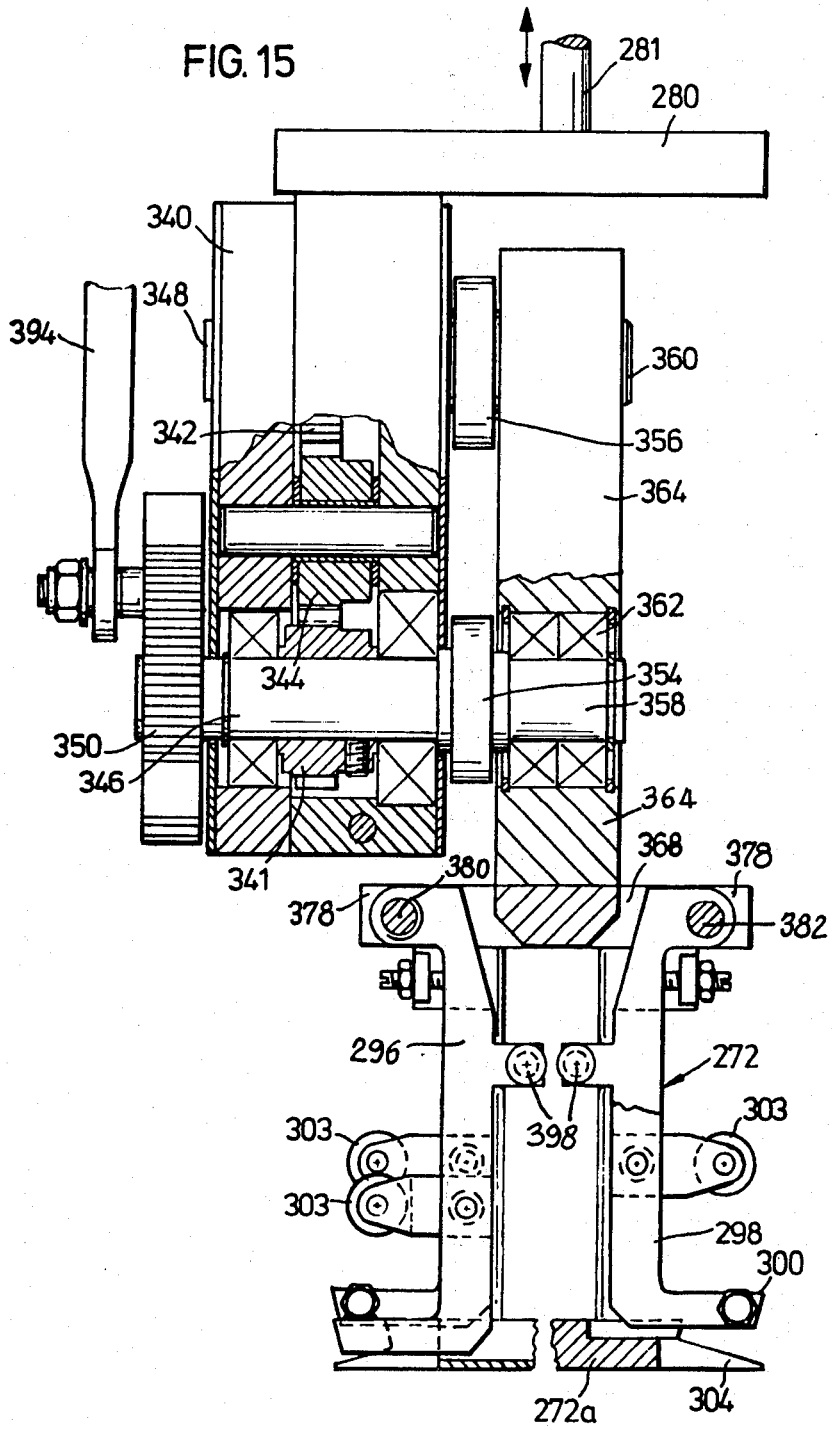
Figure 16:
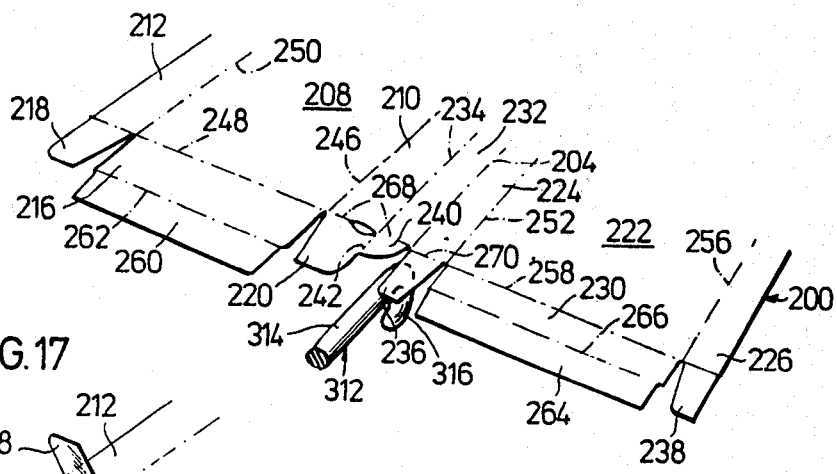
Figure 17:
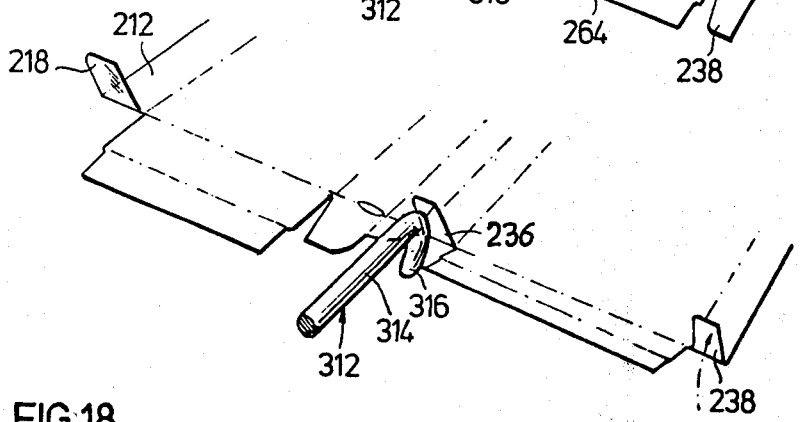
Figure 18:
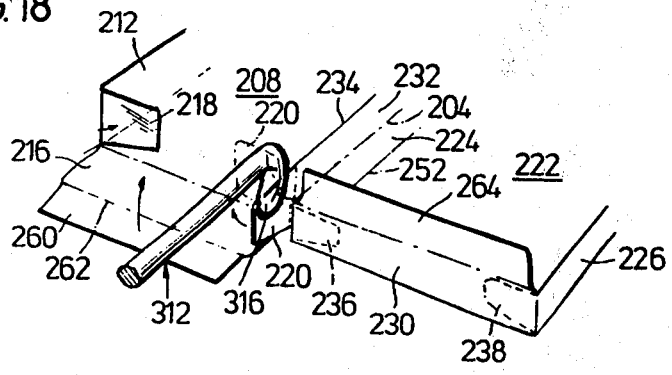
Figure 19:
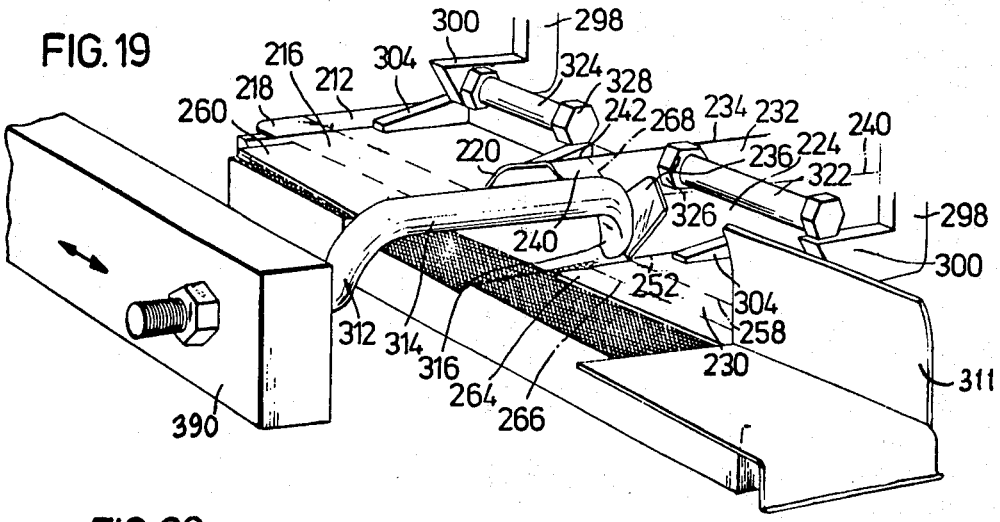
Figure 20:
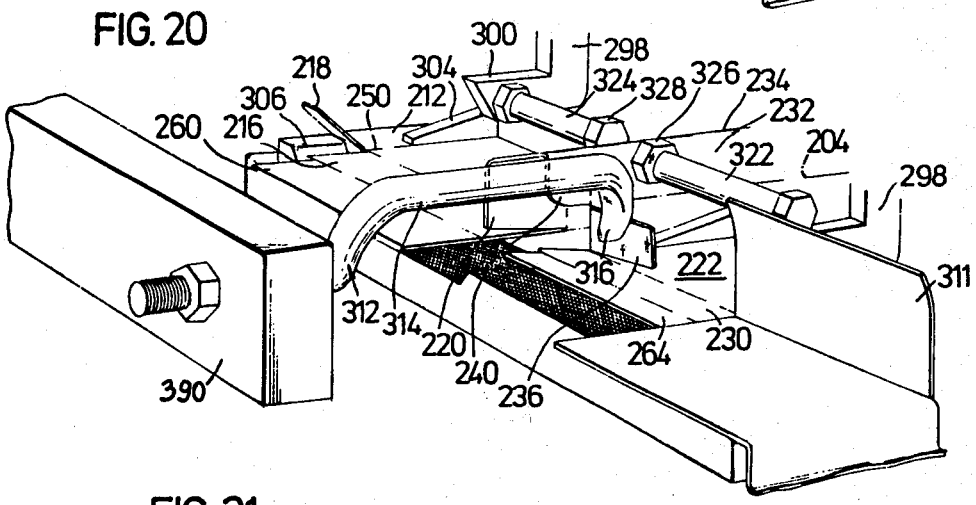
Figure 21:
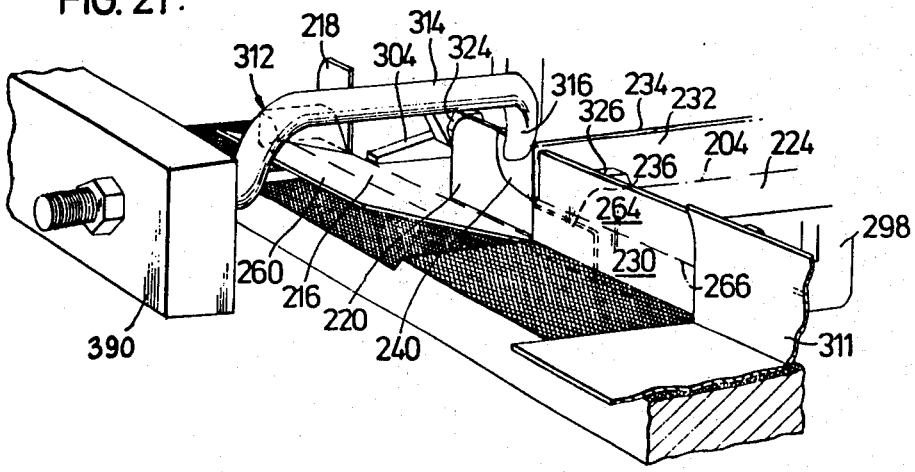
Figure 26:
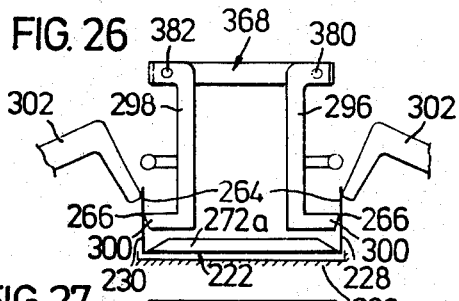
Figure 27:
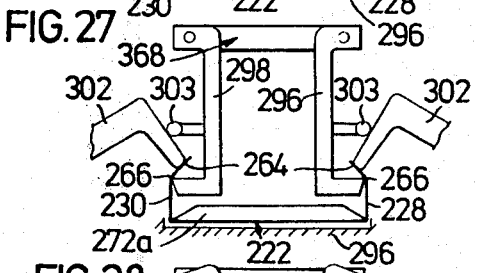
Figure 28:
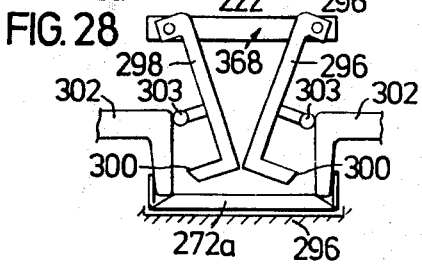
Figure 29:
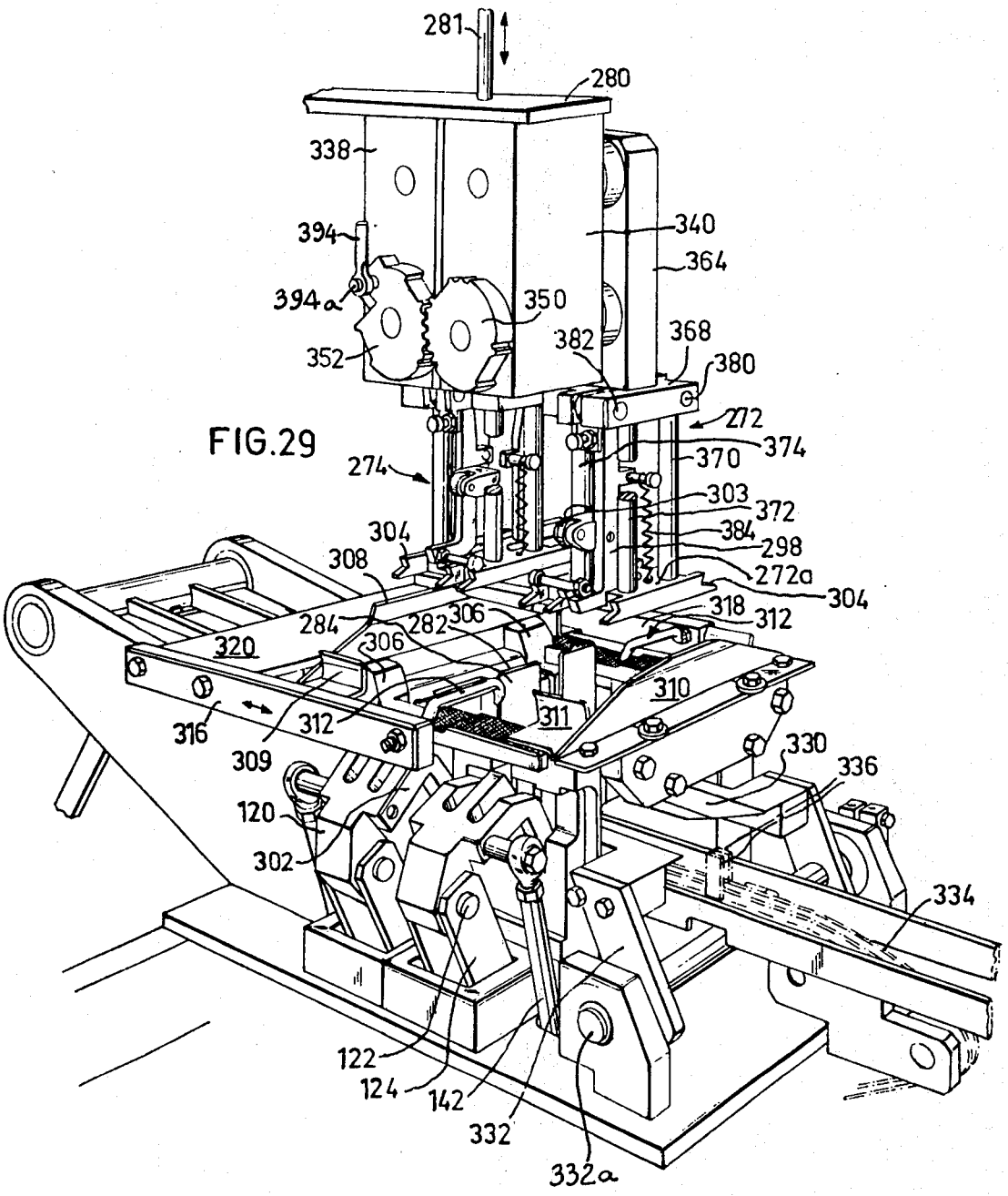

FIG. 12*a* is a sectionalized, perspective view of an erected carton formed from the blank of FIG. 12 and being shown in the open position;

FIG. 12*b* is a perspective view showing the erected carton of FIG. 12*a* in the closed position;

FIG. 13 is a diagrammatic longitudinal section through a second machine embodiment utilized to erect cartons from blanks of the type shown in FIG. 12, said sectional view being taken through its two shafts to illustrate certain main details provided for folding the blank shown in perspective in a position freely above the shafts where it is to be pushed into the shafts by a two-part plunger assembly, shown diagrammatically in FIG. 13 in a position above the blank;

FIG. 14 is a diagrammatic plan view of the machine of FIG. 13 with the two-part plunger assembly omitted;

FIG. 15 shows a partially broken front view of the two-part plunger assembly;

FIGS. 16 to 18 are perspective views of one side edge of the blank of FIG. 12 illustrating some successive steps of folding the blank by means of a tab folding finger;

FIG. 19 is an enlarged perspective view of the tab folding finger and its relationship to the carton blank during one phase of erecting the blank;

FIG. 20 is a perspective view similar to FIG. 19 showing a stage in the erection of the blank;

FIG. 21 is a perspective view similar to FIGS. 19 and 20 to illustrate a further folding operation affected by the tab folding finger;

FIGS. 22 to 25 are diagrammatic elevational views of the two parts of the plunger assembly in successive positions relative to one another and relative to the carton blank and cooperating with a movable support member for folding the hinge connection between the lid tray and the bottom tray of the carton, as well as the associated sidewalls;

FIGS. 26 to 28 are side elevations which diagrammatically illustrate successive positions of the members employed to fold the edge flaps of the bottom tray and lid tray respectively; and FIG. 29 is a diagrammatic perspective view of the second embodiment of FIG. 13.

DETAILED DESCRIPTION OF THE INVENTION

Figure 1:
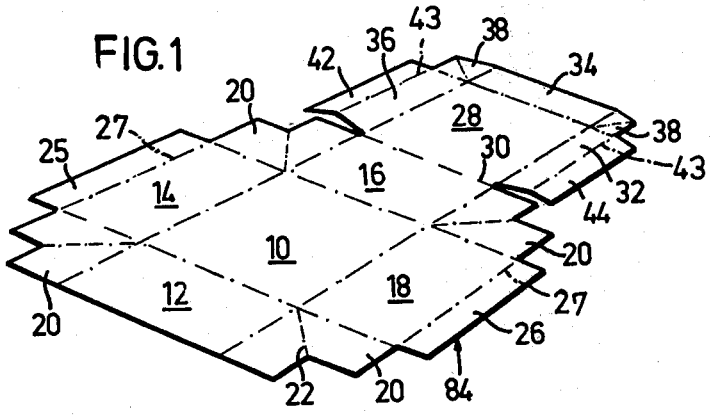

The blank in FIG. 1 is comprised of a bottom portion and a lid portion. The bottom portion has a bottom panel 10, four side panels 12, 14, 16 and 18 and corner gusset portions 20 which in a known manner are hingedly connected to the ends of the side panels and are ultimately folded double along diagonal fold lines 22 upon erecting the blank. The double folded corner portions form triangular corner flaps 24 (see FIG. 1*a*) which are intended to be secured by gluing to the interior surfaces of the adjacent side panels or to be kept in this position through any other technique. In the example shown, they are to be secured by means of edge flaps 25, 26 which form extensions of the two opposite side panels 14, 18 and are adapted to be folded along fold lines 27 down over the corner flaps 24 and secured by gluing to the inside of the adjacent side panel.

The opposing side panels 12, 16 of the bottom portion have no edge flaps which require folding. One side panel 16 is hingedly connected along its upper edge with the bottom 28 of the lid part, fold line 30 constituting the hinge connection.

The lid part has three side panels 32, 34, and 36 which at their ends are connected by means of corner gusset portions 38, 38 adapted to be double folded in the manner of portions 20, 20. In the erected lid portion these corner portions 38, 38 form triangular corner flaps 40 which are adapted to be secured in position along their adjacent side panels 32 and 38. In the example shown, the two opposite side panels 32, 36 are extended with an edge flap 42 and 42' respectively, which are folded along fold lines 43 down over the triangular corner flaps 40 and secured by gluing to the adjacent side panel as shown in FIG. 1*a*.

Figure 1A:
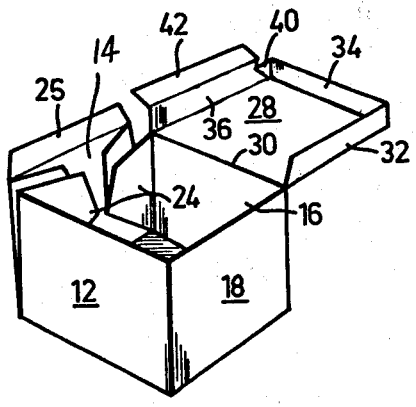
Figure 2A:
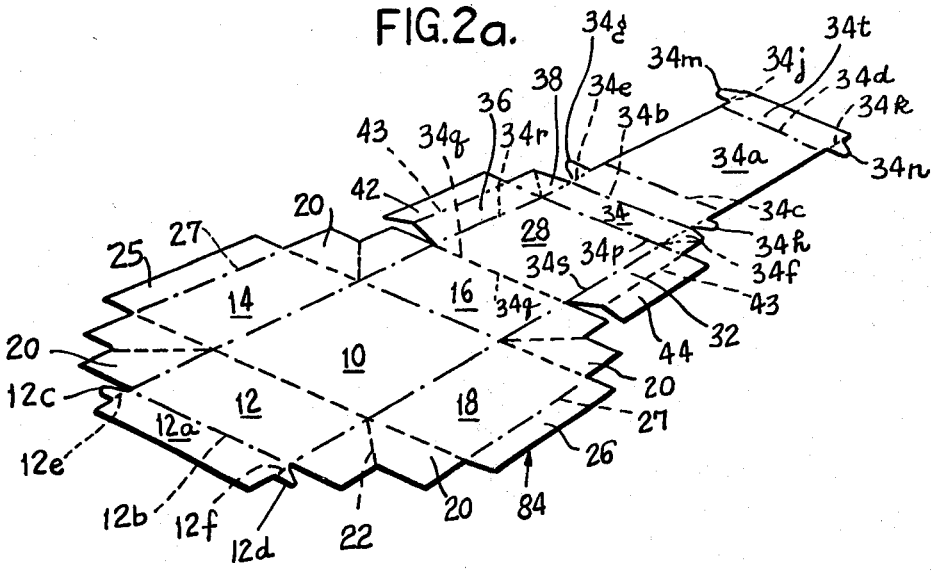

FIG. 2*a* shows an alternative embodiment 84 of the carton blank of FIGS. 1 and 1*a* wherein the carton blank 84' differs from blank 84 in that it is provided with a short edge flap 12*a* joined to side panel 12 by a fold line 12*b* and having outwardly extending tabs 12 and 12*d* joined to flap 12*a* by fold lines 12*e* and 12*f*, and an elongated panel section 34*a* integrally joined to side panel 34 and having additional fold lines 34*b*, 34*c* and 34*d*, a pair of fold lines 34*e* and 34*f* which hingedly join tabs 34*g* and 34*h* thereto, and a pair of fold lines 34*j* and 34*k* which hingedly join tabs 34*m* and 34*n* thereto.

In a prefolding and pregluing operation performed prior to the erecting operation of the carton, flap 12*a* is folded along line 12*b* against side panel 12 (FIG. 2*b*) and glued. However, tabs 12*c* and 12*d* are not glued to corners 22, 22. Also, panel section 34*a* is folded inwardly and glued so that fold line 34*c* is aligned with fold line 34*p* and 34*j* are aligned with fold line 34*r*, and fold lines 34*f* and 34*k* are aligned with fold line 34*s*. Outermost flap 34*t* is folded against the upper part of sidewall 16, as shown best in FIG. 2*a*. However, tabs 34*g*, 34*h*, 34*m*, and 34*n* are not glued to the corners 38, 38, 20 and 20 respectively.

The carton blank 84' shown folded and glued in FIG. 2*b* constitutes another blank used in the erection operation to be described in connection with FIGS. 3–11. The erection operation performed on blank 84' is identical to that described hereinabove except that the tabs 12*d*—12*d*, 34*g*–34*h* and 34*m*–34*n* perform the following function (since all of the aforementioned pairs of tabs function in substantially the same manner only one such set of tabs will be described herein for purposes of simplicity):

As the blank is moved downwardly into the cavities 44, 46 the side panels 12, 14, 18, 32, 34 and 36 are moved to their upward vertical positions. Simultaneously therewith, the triangular corners are folded inwardly as shown in FIG. 2*c*. The tabs 12*c* and 12*d* are bent inwardly against the triangular corners 22, 22 and act to urge the folded triangular corners toward side panels 14 and 18 so that the folded corners will lie beneath the edge panels 25, 26 when they are folded downwardly and inwardly in the same manner as previously described for the carton blanks 84.

Tabs 34*m*–34*n* similarly urge folded corners 20, 20 against side panels 14 and 18 so that they will be beneath edge flaps 25 and 26; and tabs 34*g*–34*h* urge folded corners 38, 38 against side flaps 36, 32 so that these folded corners will lie beneath edge flaps 42 and 44 when these edge flaps are folded downwardly and inwardly in the manner previously described.

Figure 2B:
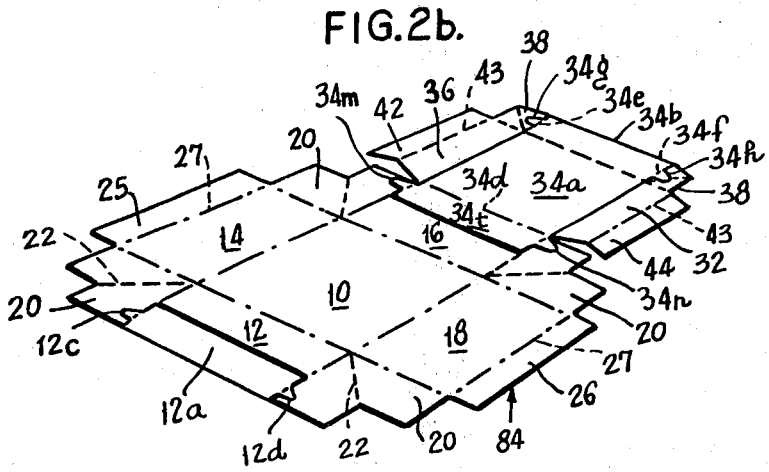
Figure 2C:
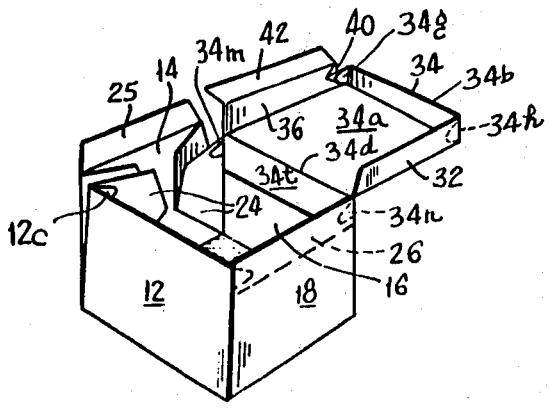
Figure 3:
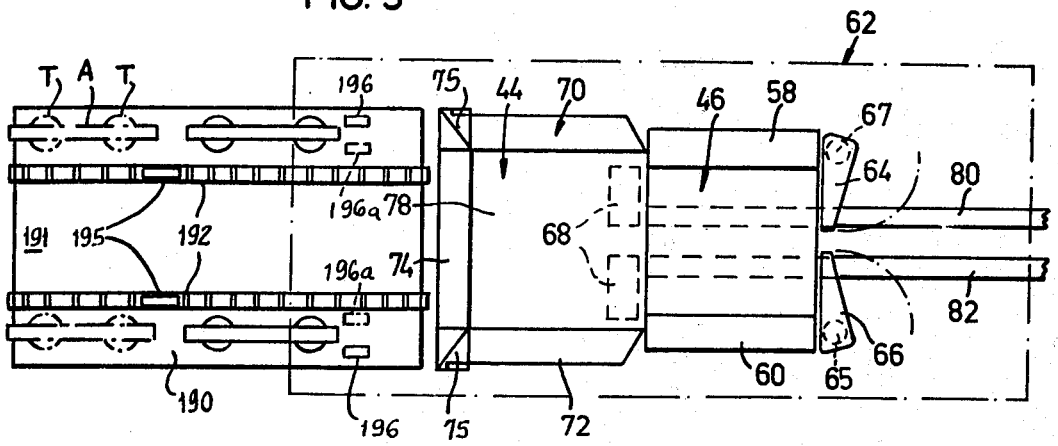
FIG. 3 is a diagrammatic plan view of a portion of the erecting apparatus and a carton being erected in position in two juxtapositioned shafts of the apparatus.
Figure 4:
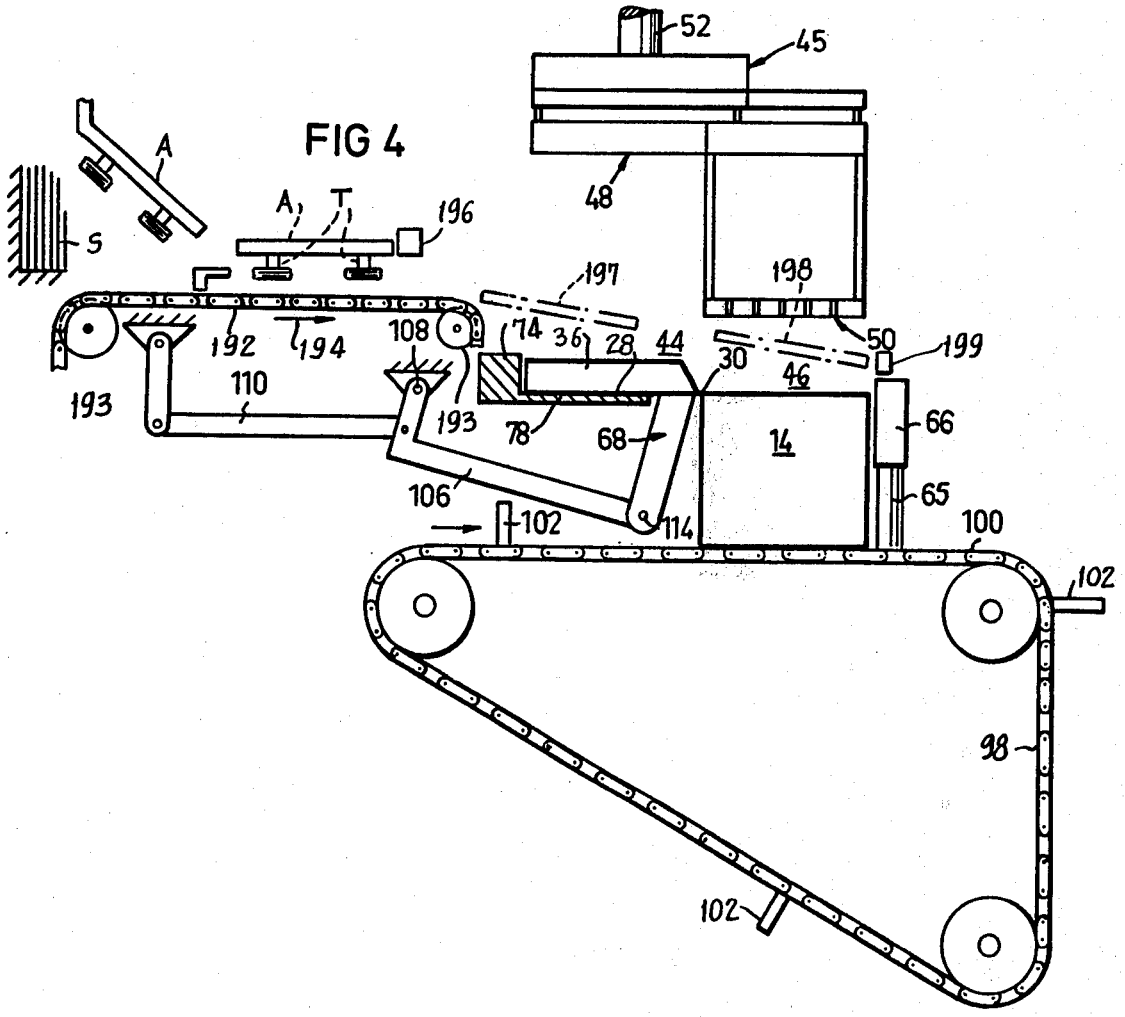
FIG. 4 is a diagrammatic longitudinal section through the two shafts of FIG. 3 with the plunger in its upper end position and a movable support member engaging the underside of the lid at the hinged connection between the lid and one side edge of the bottom tray.
Figure 6:
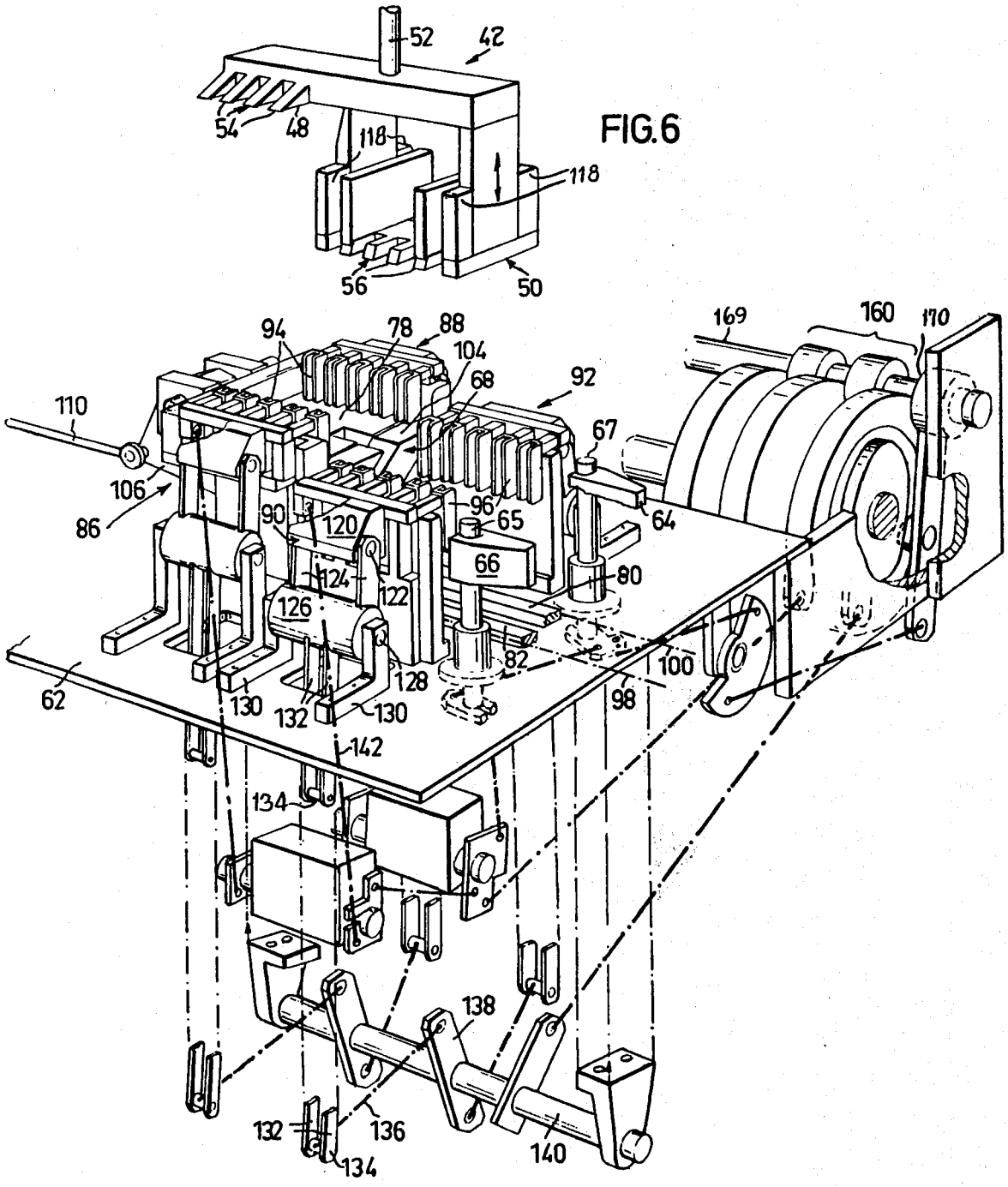
FIG. 6 is another diagrammatic perspective view of the machine with certain details in FIG. 5 omitted and other details shown in order to disclose the driving connections to certain movable parts of the machine.

FIGS. 4 and 6 show diagrammatically a plunger 45 which is used for pressing the carton blank of either FIG. 1 or FIG. 2*b* downwardly into two adjacent shafts 44, 45 (see also FIG. 3) in order to erect the side panels of the lid part and the bottom part as the blank is pushed into the shafts.

Figure 9:
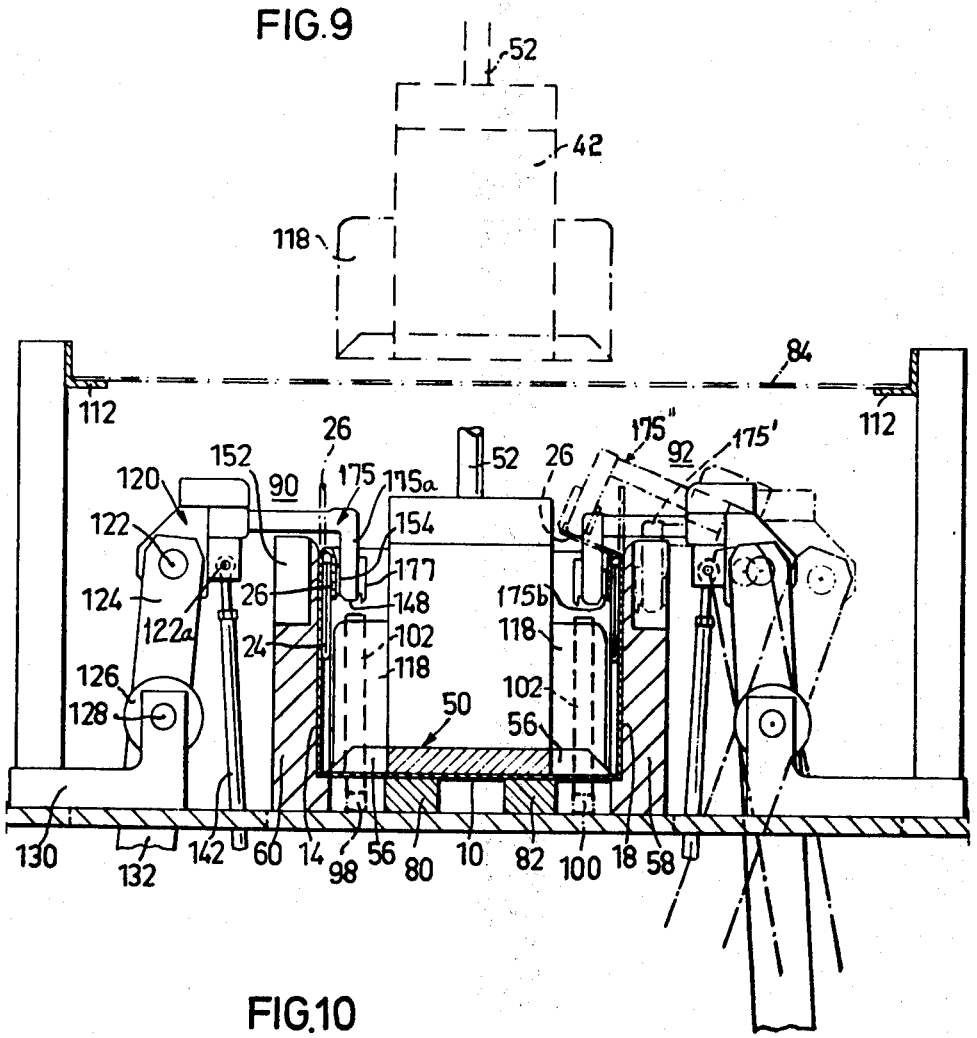
FIG. 9 is a diagrammatic cross-section of the machine taken through the deeper one of the two shafts.
Figure 10:
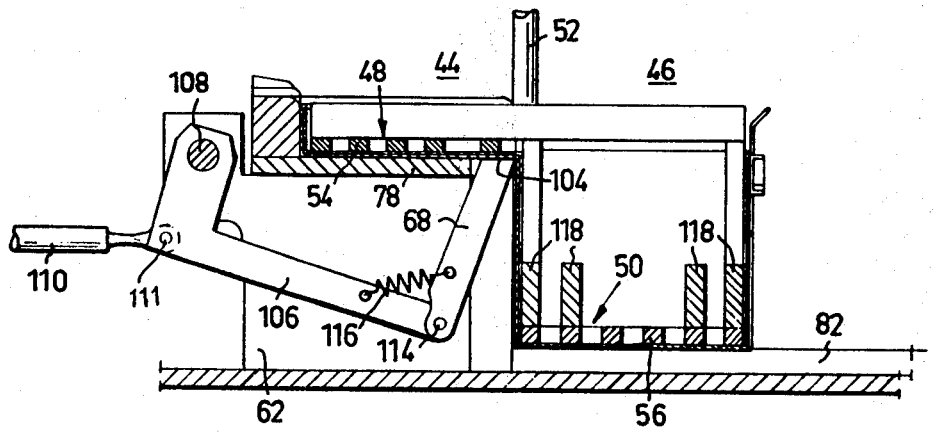
FIG. 10 is a diagrammatic longitudinal section through the two shafts and through the plunger located therein, the plunger having its bottom plates in their bottom-most positions in order to hold the bottoms of the lid tray and the bottom tray against stationary bottom supports.

The plunger 45 is provided with two bottom plates 48, 50 which, in the example shown, are located at different levels. The lower bottom plate 50 is adapted to press against the bottom panel 10 of the bottom portion of the blank and has substantially the same size as the bottom 10. The bottom plate 48 which is elevated relative to plate 50 is adapted to press against the bottom 28 of the lid portion and has substantially the same size as lid portion 28. In the example shown, the two bottom plates are rigidly connected with each other and are carried by a vertical shaft 52 which is actuated by a driving mechanism (not shown in detail) so as to be moved between an upper end position and a lower end position. The upper-most end position of the plunger is shown in FIGS. 6 and 9 and its lowermost end position is shown in FIG. 10. The driving mechanism for moving the plunger is synchronized with the movement of the other movable parts of the machine.

At its opposite side edges the two bottom plates 48, 50 are provided with fingers 54, 56 which will be explained below.

As will be seen from FIG. 10, one hollow shaft 46 is deeper than the other hollow shaft 44 for receiving the bottom part of the carton whereas the other hollow shaft 44 has a bottom part elevated relative to hollow shaft 46 and is adapted to receive the lid part of the carton.

The hollow shaft 46 for the bottom part is defined by two opposite stationary side pieces 58 and 60 (FIG. 3) which are secured to the frame of the machine, the frame being denoted generally be reference numerals 62. Many details of the frame have been omitted from the drawings for purposes of simplicity. However, a number of frame members are shown which carry certain of the movable or stationary parts of the machine or are necessary for certain important functions in connection with the present invention. The intention with omitting certain details in the illustration is to facilitate the understanding of the drawings.

One of the two remaining opposite sides defining shaft 46 is comprised of two doors 64, 66 which are pivoted and may be rotated about vertical shafts 65, 67 (FIGS. 3 and 4) from a closed position where they form one sidewall of the hollow shaft 46 and carton erecting members to an open position. The other opposite side of the shaft 46 is defined by a vertically movable support member 68 which is adapted to rest against the underside of the bottom 28 of the lid adjacent the fold line 30 between the lid part and the bottom part, as indicated in FIGS. 4, 8 and 10.

The hollow shaft 44 of the lid part is defined by two opposite stationary side pieces 70, 72 (FIG. 3) and a stationary transverse side piece 74. These three side pieces are adapted to cooperate with the side panels 32, 34, 36 of the lid part for erecting the same.

At the upper ends of the two shafts are members 75 (FIG. 3) and 76 (FIG. 5) which in a known manner per se are intended to cooperate with the corner gusset portions between the side panels for folding these corner portions to form the corner flaps 40, 24 (FIG. 2) which ultimately lie along the side panels in the carton when erected.

Figure 8:
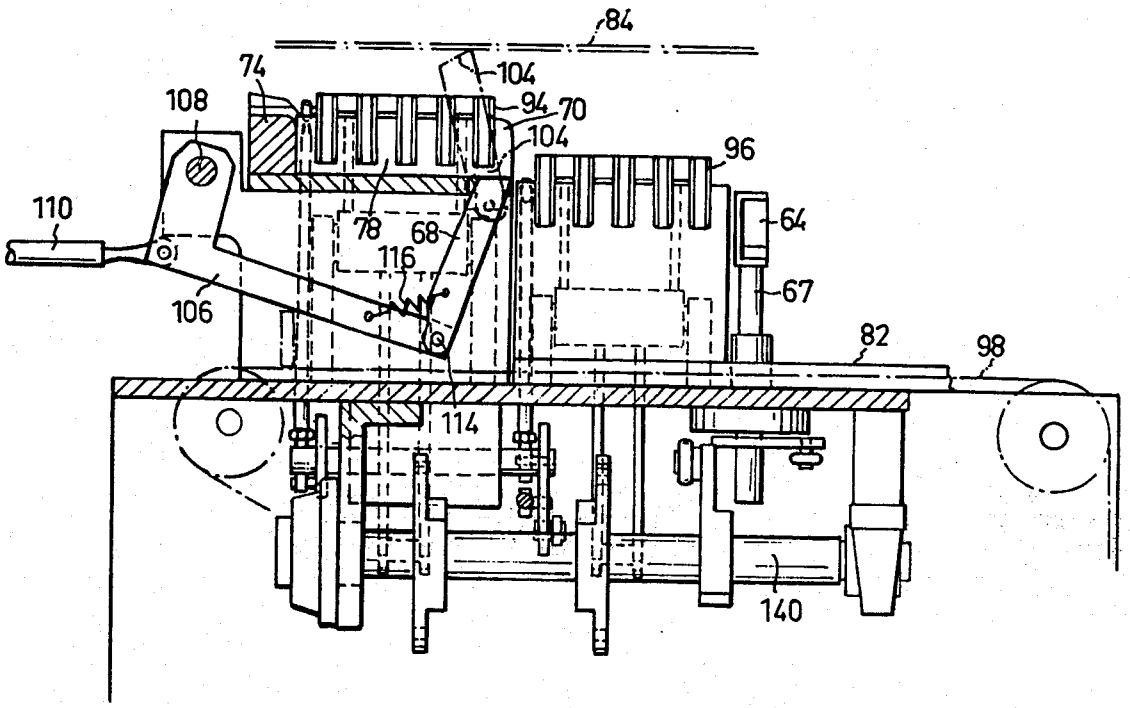
FIG. 8 is a longitudinal section through the two shafts corresponding to FIG. 4 but with still more details shown in order to explain the functions of the details.

In the hollow shaft 44 for the lid part is provided a stationary bottom support 78 which has its forward end located adjacent the vertically movable support member 68, as will be understood from FIGS. 4, 8 and 10.

Figure 5:
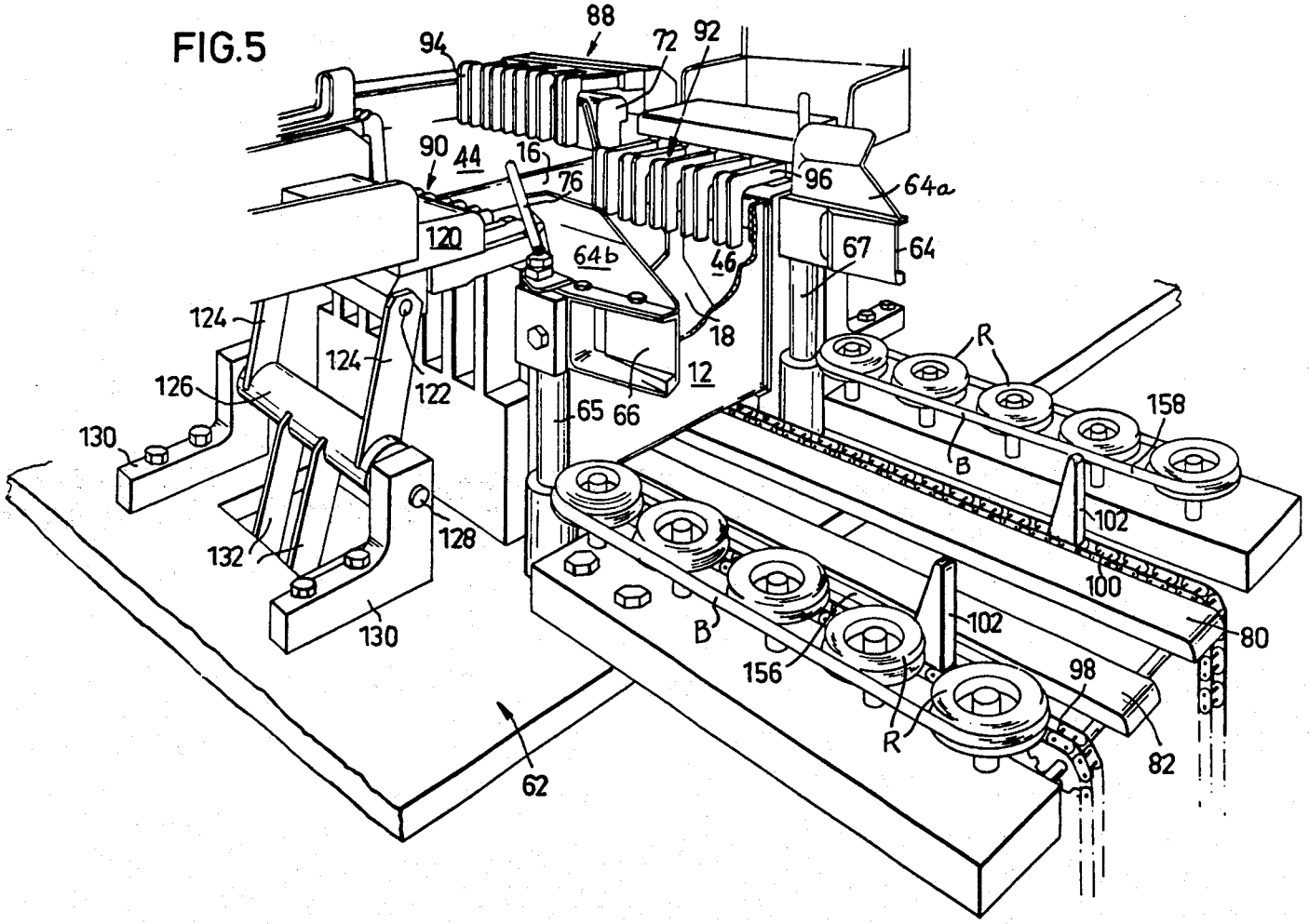
FIG. 5 is a diagrammatic perspective view of the machine with certain details omitted for the sake of clarity.

In the shaft 46 for the bottom part is a stationary bottom support in the form of two parallel longitudinally extending stationary rails 80, 82. These rails extend outside the shaft 46, as shown in FIGS. 3 and 5, and cooperatively form a conveyor for the carton when erected in a manner to be described below.

As will be understood from the above and from FIGS. 1 to 5, the carton will be erected in the following manner:

The carton blank 84 (see FIGS. 1, 3, 4 and 9) is picked up from a supply S of such blanks arranged in a vertical fashion (FIG. 4) by means of a pair of arms A—A (FIGS. 3, 4) each having a plurality of suction teats. The arms A,A "grab" the right-hand-most blank from Supply S and rotate the blank to a horizontal position above a table 190 having an elongated slot 191 for receiving linearly movable closed loop chains 192, 192 guided by suitable sprockets and driven by a motor (not shown) to move the chains in the downstream direction, shown by arrow 194 (FIG. 4). The vacuum in arms A,A is released causing the carton blank to drop onto table 190. The chains 192 are provided with upwardly extending "pushers" which abut the upstream or left-hand edge of the carton blank (FIG. 4) and move the blank toward the erecting position.

As the blank is moved in the direction of arrow 194 a pair of glue aplicators 196 are moved vertically downward by means not shown for purposes of simplicity so that their glue dispensing ends are above the carton blank. An elongated bead or strip of glue is first simultaneously deposited along edge flaps 25, 26 (see FIG. 1). Thereafter, a second pair of glue applicators **196*a*, 196*a* are moved vertically downward as edge flaps 42, 44 pass beneath the glue applicators 196*a*, 196*a* to simultaneously lay down a stripe or bead of glue along each of these edge flaps. As the rearward edges of flaps 25, 26 pass the applicators 196, 196 they are deactivated and moved upward. Similarly, as the rearward edges of flaps 42, 42 pass applicators 196*a*, 196*a*, they are deactivated and moved upwardly. Alternatively, the second pair of applicators 196*a*, 196*a* may be dispensed with and replaced by a mechanism (not shown) for moving applicators 196, 196 outwardly immediately after laying down beads on edge flaps 42, 44 so as to lay down beads on edge flaps 25, 26 when the flaps receiving these beads pass beneath applicators 196, 196.**

The "pushers" 195, 195 continue to move the carton blank downstream so as to move above shafts 44, 46. The marginal edges of the blank move upon a pair of horizontally aligned guides 197 (FIGS. 4, 9) as the blank continues to move along its forward marginal edges engaging a pair of diagonally aligned guides 198 forcing the forward edges to move diagonally (i.e., downward and to the right) until the forward edges engage a pair of stationary stops 199 which halt any further movement of the carton blank in the downstream direction.

Thereafter, the plunger 45 is moved downwardly to press the blank downwardly into the two cavities or shafts 44, 46 to such an extent that the bottom of lid portion 28 rests upon the stationary bottom support 68 (FIG. 4) and the bottom 10 of the bottom portion will rest against the stationary bottom rails 80, 82 (FIGS. 5 and 6). The two bottom panels 28, 10 are pressed against the stationary bottom supports by means of the bottom plates 48, 50 of the plunger. The two bottoms of the carton and its side panels will thus be secured in a very accurate and fixed position. The corner portions 20, 20 engage upwardly projecting members **64*a*, 64*b* as the blank is moved downwardly by the plunger to bend the corners along their fold lines. The corner portions 38, 38 are similarly bent along their fold lines by upwardly extending projection 76 (see FIG. 5**).

The edge flaps 25, 26, 42 and 44 at the opposite side panels are then folded inwardly and downwardly to engage the adjacent side panels. This fold operation is performed by means of devices in the form of four pivotally journalled and vertically movable members 86, 88, 90 and 92 (see FIG. 6) each having a number of L-shaped fingers 94 and 96. These members are provided at each of the two opposite sides in the two shafts 44, 46 (see FIG. 6). When the edge flaps 25, 26, 42 and 44 are secured by gluing over the corner flaps 24 and 40 the movable fingers 94 and 96 will return from their pressing position (FIGS. 5, 6, 7 and 8) to their resting position, which is indicated by dotted lines in FIG. 9. The plunger 45 will then have been moved from its lower end position (solid lines in FIG. 9) to its upper end position (dotted lines in FIG. 9). The carton is now erected and is moved out from the shafts. The doors 64, 66 are opened so that the downstream side of the shaft 46 will be opened. Parallel with the stationary bottom rails 80, 82 are two endless chains 98, 100 (FIG. 5) which carry upwardly extending vertical rods 102 spaced from each other along the length of the chains. The chains are moved a predetermined distance so that the rods 102 next behind the bottom tray as erected will be brought to engagement with the bottom tray and feed the carton along the rails 80, 82 and out through that side of the shaft which has been opened. The erected cartons are then fed between belts B—B entrained about rollers R which may be either power-driven or free-wheeling.

Following the above general description of the main parts of the machine and their functions, the various devices will now be described in more detail.

Figure 11:
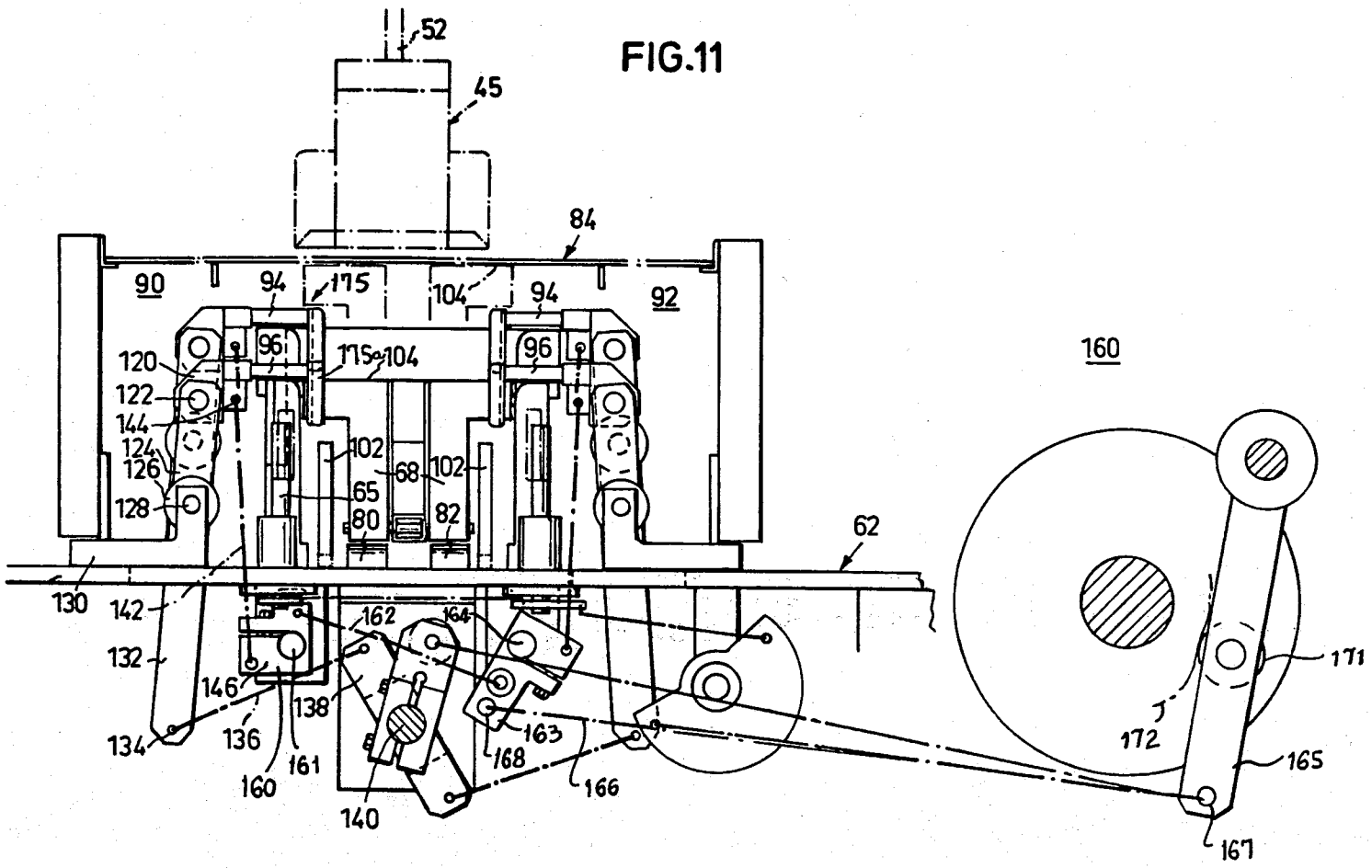
FIG. 11 is a diagrammatic front view of the machine for disclosing the connections between certain movable details in the machine.

As will be seen from FIGS. 7, 8, 10 and 11, the support member 68 is comprised of a T-shaped plate which in the example shown is comprised of two L-shaped parts (FIG. 11). The upper edge of the plate forms a support surface or edge 104 which is intended to support the underside of the bottom panel 28 of the lid portion adjacent the hinge line 30 (FIG. 10) when the side panels of the bottom tray are erected in the shaft 46 due to the downward movement of plunger 42. In FIGS. 8 and 11, support member 68 is shown in its uppermost position in dotted line fashion and in its lowermost position in solid line fashion. The support member 68 is carried by an arm 106 which is pivotally journalled on a stationary shaft 108.

A link 110 is pivotally connected to arm 106 by pin 111 (FIG. 10) and is subjected to a to-and-fro movement of a rotating cam which is synchronously driven with the movable parts of the machine. When the blank 84 is fed into a position on side supports 112 in the starting position indicated by dotted lines in FIG. 9 beneath the plunger 45 in its upper end position, the support member 68 is in an upper position where its support edge 104 will be located at a predetermined height above the stationary bottom support 78 in the shaft 44 for the lid portion. The support edge 104 of the support member has its upper end positioned at a level located higher than the upper side of the side pieces 70, 72 (see FIG. 3) and forms a vertically movable side piece for the shaft 46 to support side panel 16. When the blank is driven downwardly off the supports 112 by plunger 45 so as to rest on the support edge 104 of the support member, the plunger 42 will then start to fold the bottom portion of the carton over the support edge 104 and down into the shaft 46 for erecting the side panels 12, 14, 16 and 18 of the bottom portion. At the same time, the support member will be successively lower. Thereafter, the bottom plate 48 will start to press down the lid portion into the shaft 44 for erecting the side panels 32, 34, 36 of the lid portion. Lowering the support member 68 is then provided to follow this downward movement of the plunger in order to form a support against the bottom of the lid portion adjacent the fold line 30 when erecting the side panel 16. The support member 68 controls the erection of the side panel 16 of the bottom portion and moves panel 16 to a vertical position upon maintaining a satisfactory guide of the carton portions which will result in the carton portions being erected and moved to an exact position in relation to each other.

The support member 68 is pivotally mounted to arm 106 by shaft 114 and is actuated by a spring 116 which is provided to bias the support member 68 to make sliding contact with the front edge of the stationary bottom support 78 or other stationary guides in such a way that the support edge 104 of the support member will assume the different positions shown in FIG. 8 as it moves along a path extending from the uppermost position of the support member shown as 68 in dotted fashion (FIG. 8) to a lowermost position, shown in solid line fashion in order to be in contact with the bottom 28 of the lid portion adjacent the fold line 30 between the bottom 28 of the lid and the adjacent side panel 16 of the bottom tray as the blank is moved downwardly by plunger 42. Spring 116 acts to normally urge arm 68 counterclockwise about its pivot 114 and allows edge 104 to properly rest itself against the carton blank in the region of fold line 30 (FIG. 2).

As referred to above the two bottom plates 48 and 50 of the plunger are provided with a number of straight fingers 54 and 56 at the side edges of the plate. These fingers are spaced with such a distance from each other and are located in such positions relatively to the movable fingers that the fingers of the plunger may pass between the movable fingers when these are in their position for pressing against the edge flaps 25, 26, 42 and 44 upon gluing the same to the inside of the side panels and the plunger 45 is moved from its lower end position to its upper end position.

As will be seen from FIG. 9, the bottom plate 50 is provided with a number of vertically aligned plates 118 (see FIG. 6) extending upwardly and having their outer vertical edges positioned adjacent the inside of the side pieces 58, 60 (see FIG. 3) of shaft 46 in order to form supports against the side panels when their edge flaps 25 and 26 are being folded inwardly and downwardly in the manner described below.

Since all four members 86, 88, 90 and 92 for folding the edge flaps are designed in the same manner, merely one member 90 of these four members will be described in detail with reference to FIGS. 5–11.

A block 120 (FIG. 6) is pivotally journalled on a horizontal shaft 122 carried by a pair of arms 124 which are secured to a hub 126 rotably journalled on a stationary shaft 128 which is carried by a pair of brackets 130 on the frame of the machine. At the lower side of this hub is secured a pair of arms 132 which at their lower ends are connected with a link 136 shown in dotted fashion (FIG. 11), in turn, is subjected to a reciprocating movement from a crank lever 138 secured to a shaft 140 which is rotatable between two end positions.

The pivotal movement of the block about the shaft 122 is controlled by a substantially vertically aligned link rod 142 (FIG. 9) whose upper end 104 is hingedly connected to the block 120 by pin 122*a* whose lowere end is connected with a cam-controlled crank arm 160 to carry out a predetermined movement up and down. Crank arm 160 pivots about stationary shaft 161. A linking arm 162 (shown in phantom line fashion) links arm 160 to a similar crank arm 163 pivoted about shaft 164. Crank arm 163 is linked to an arm 165 by link 166 (shown in phantom) and pivot pins 167, 168. Arm 165

(FIGS. 6 and 11) is mounted to pivot about shaft 169 by collar 170. Arm 165 has a rotatable cam follower roller 171 which follows the periphery of cam 172.

On the block 120 are secured the L-shape fingers 175 which have a free downwardly directed outer arm 175*a* provided with an end surface which is intended to rest against the adjacent edge flap when starting the folding of the edge flap.

At least some of the fingers may be provided with a nail shaped projection 177 (FIG. 9) at the end of the finger. The nail extends beyond the end of the finger 175*a* in order to be able to engage the free edge of the flap at the beginning of its folding movement and so that the finger may maintain its engagement with the edge flap.

In the starting position shown in dotted line fashion 175' in FIG. 9, all fingers are located in pockets 152 on the back side of the side piece 60, the front side of which is smooth. This starting position is shown by dotted lines for the right-hand-set of fingers in FIG. 9.

In the right-hand position of FIG. 9 is shown the folding member 92 with its parts in three different positions, namely in the resting position in dotted line, where the arms 146 are positioned in the recesses 152 and the edge flap 26 is shown in an upright position in dotted lines, in the pressing position where the arm 146 engages the edge flap 26 when folded down and presses this flap against the side panel 18 for gluing to the same, and in an intermediate position in dotted lines where the arm 96 with the end of its arm 146 has folded the edge flap 26 to a position where the flap is directed inwardly. These positions and intermediate positions are obtained in the following manner.

From the resting position the fingers are raised by rotating the block about its shaft by means of the link rod 142 until the ends of the fingers have been positioned at a higher level than the upper side of the side piece shown in dotted line fashion as position 175''. Thereafter, the arm is turned inwardly by rotating hub 126 about shaft 128 so that the fingers will be moved to contact with the adjacent vertically upstanding edge flap (see edge flap 26 in FIG. 9). The fingers will engage the free edge of the edge flap so that the nail 177 will engage closely above the edge of the edge flap. Thereafter, the arms will be substantially standing still and the continued movement of the fingers will be affected by pivoting the block 120 about its shaft 122 by downward movement of the link rod 142.

The ends of the fingers will then follow a substantially circular arc-shaped path having its center adjacent the fold line of flap 25 (and 26). When the edge flap reaches a position substantially at right angles to the adjacent side panel, the end surfaces of the fingers will release their contact with the edge flap and then the inside surfaces of the fingers will make this contact. On the inside of the fingers are elastic pressure members 175*b* which now rest against the edge flap. When the edge flap is positioned substantially parallel along to its side panel, the arms are pivoted somewhat outwardly which results in the pressure members elastically pressing against the edge flap in order to subject the same to a pressure during a predetermined interval so that the glue between the edge flap and the side panel will have time to harden. During this interval the plunger will be redrawn to its upper end position and the next blank is fed to its position beneath the plunger. This is permissible due to the fact that the gaps between fingers 175 permit the fingers 56 of bottom plate 50 to freely pass therethrough.

The movements of the movable fingers 94, 96, the doors 64, 66, the plunger 45 and the support member 68 are synchronized by means of members known per se and controlled for predetermined mutual movements by means for cam discs 160 as indicated diagrammatically, for example, in FIGS. 6 and 11 where a number of links are merely indicated by dotted lines. The drive of the chains 98, 100 is also synchronized in relation to the movements of said parts by means of devices known per se.

When the gluing has "set", the fingers 94, 96 are returned to their resting position. Meanwhile the doors 64, 66 have been opened and the erected carton is fed out on the rails 80, 82 so as to be advanced by pushers 102, 102 on the chains 98 and between two endless conveyors 156, 158 (FIG. 5) which feed the carton to any desired place.

FIG. 12 shows still another carton blank 200 adapted to be erected into the recloseable carton shown in the open position in FIG. 12*a* and in the closed position in FIG. 12*a* and having a bottom or tray part 202 hingedly connected along a hinge line 204 to a lid part 206. In this example, the hinge line 204 is located substantially midway between the upper and lower edges of the side panels of the bottom part 202 or alternatively may be located closer to the lower edge of said side panels, if desired.

In the closed position shown in FIG. 12*b*, the four side panels of the lid part 206 will form a closed frame surrounding the bottom or tray part 202.

The bottom part comprises a central panel portion 208 and four side panels 210, 212, 214 and 216. The side panels 210 and 212 each have end tabs 218, 218 and 220, 220 respectively.

The lid part comprises a lid panel central portion 222 and four side panels 224, 226, 228 and 230.

A hinged common panel section 232 hingedly connects the bottom part and the lid part and is located between the hinge line 204 defining the edge of panel 224 and a further hinge line 234 defining the edge of panel 210.

Side panels 224 and 226 each have end tabs 236, 236 and 238, 238 respectively.

Hinge panel 232 has small end tabs 240, 240 whose sides are displaced from the adjacent sides of tabs 236, 236 but whose opposite sides are integrally joined with tabs 220, 220 and foldable relative thereto along a fold line 242.

The side flaps of the tray and lid portions are respectively foldable along fold lines 244, 246, 248, 250 and 252, 254, 256 and 258.

Tray side panels 214, and 216 each have an edge flap 260, 260 foldable along a fold line 262, 262 and side flaps 228, and 230 each have an edge flap 264, 264 foldable along a fold line 266, 266.

The end tabs 220, 240 are each foldable along a fold line 268 forming an extrusion of fold line 244 and 248 respectively, and tabs 236 are each foldable along a fold line 270 forming an extension of fold line 254 and 258 respectively.

Each fold line 268 is broken by a slot 272 to further facilitate folding of the tabs.

Each fold line 268 is somewhat offset relative to its associated fold line 270 in a manner known per se.

In order to facilitate the understanding of the operation of the alternative embodiment of the machine shown in FIGS. 13 to 29 when folding the blank 200 in FIG. 12 to the open carton in FIG. 12*a*, reference is first made to the main features of the machine for folding the blank.

As in the first embodiment of the machine described hereinabove, there is a plunger assembly which in this embodiment comprises two movable interconnected plungers 272 and 274 (see longitudinal sectional views shown in FIGS. 22–25) which are carried by the pairs of members 276 and 278 respectively, diagrammatically shown as links in FIGS. 22 to 25, but preferably in the form of eccentric members as shown in FIGS. 13, 15, 29, these members being carried by a head 280 which is secured to a vertically aligned reciprocable shaft 281. The two plungers 272 and 274 are adapted to respectively engage the bottom panel 222 and the lid panel 208 of the flat blank 200 when it has been fed into position below the double plungers 272, 274 in FIG. 22 (in a manner similar to that shown in FIGS. 3 and 4) and the plunger members 272, 274 have been lowered to the position shown in FIG. 23. The blank is then positioned above two hollow forming shafts 273 and 275 (see FIG. 13).

Figure 22:
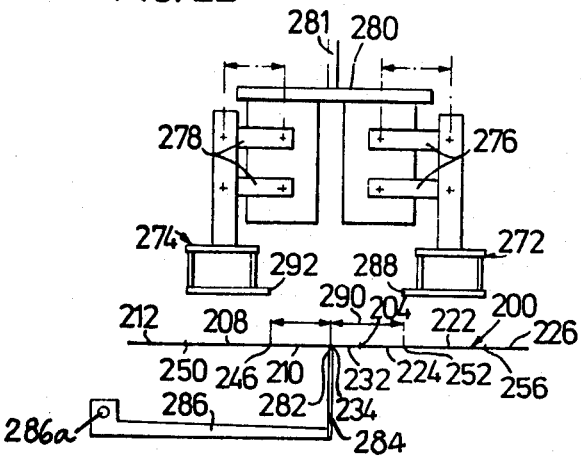
Figure 23:
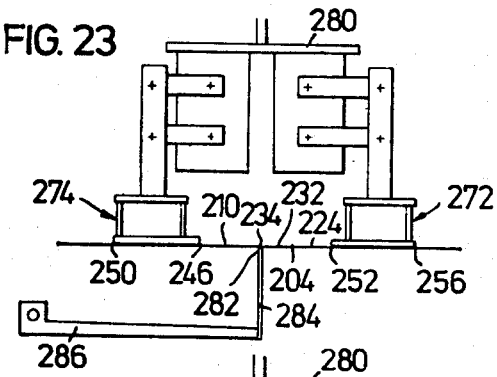

As will be seen from FIGS. 22 and 23, the blank is resting on the upper edge 282 of a supporting member 284 carried by an arm 286 pivotally mounted at 286*a*. The support edge 282 engages the blank along the fold line 234. The blank is further supported at its edge portions by folding members at the sides of the two forming shafts, but these members have been omitted in FIGS. 22 to 28 for purposes of simplicity.

Figure 24:
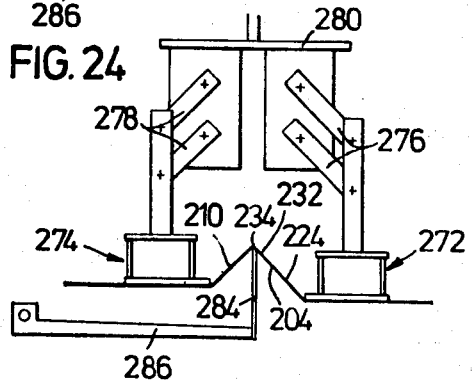
Figure 25:
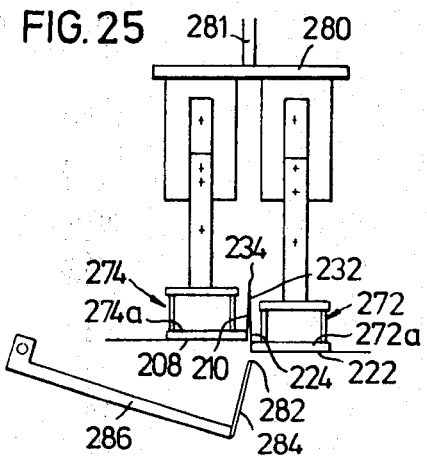

The reciprocating shaft is moved from the position shown in FIG. 22 to the position shown in FIG. 23, at which time the head 280 is brought to a stop and the pairs of links 276 and 278 are rotated so that the plungers 272 and 274 will be moved downwardly and moved towards one another along a circular arc, the inner edge 288 of plunger 272 following an arc having its center substantially coincident with the edge 282 of member 284 and having a radius 290 equal to the width of the side panel 224 and the hinge panel 232, whereas the inner edge 292 of plunger 274 will follow an arc having its center substantially coincident with the edge 282 and a radius to the width of the side panel 210. As a result, the blank will be double folded over both sides of the support edge 282 of the plate 284 as indicated in FIGS. 24 and 25, such that the side panel 210 is moved towards one side of plate 284 and the side panel 224 and hinge panel 232 are moved towards the other side of the support plate 284. Once the plunger members reach the position shown in FIG. 24 the plate 284 will be retracted by rotating the arm 286 downwardly as indicated in FIG. 25.

FIGS. 22–25 are diagrammatic longitudinal sections of the machine, whereas FIGS. 26–28 are cross-sectional views of the forward forming shaft 275 intended for the lid part of the carton. The details shown in FIGS. 26–28 are provided also at the rear forming shaft 273 for erecting the bottom part of the carton.

FIGS. 26–28 show the position of the plunger members 272, 274 when they have pressed the blank substantially completely into the hollow shafts 273, 275 and the side panels of the bottom part and the lid part of the carton have been erected as a result of engagement with the side walls of the hollow shafts and the bottom panel 208 and the lid panel 222 are held by plungers 274 and 272 respectively, against stationary bottom supports 294 and 296 respectively (FIG. 13), in accordance with the invention as described more in detail in connection with the first embodiment of FIGS. 3–11.

From FIG. 26 it will be seen that the head of the plungers 272, 274 carries L-shaped arms 296, 298 each having a free lower end 300 which engages the inside of the side panel 228 and 230 respectively, at the fold line 266. The arms 296, 298 are pivotally mounted at 380 and 382. Thus, when the folding fingers 302 (which are similar to flap folding fingers 175 of FIG. 9) initially engage the edge flaps 264 and bend them inwardly as shown in FIG. 27, this is performed accurately without deflecting the side panels 228, 230 inwardly. When the edge flaps 264 have been folded to the intermediate position in FIG. 27, the fingers 302 abut (at a position above the free ends of the fingers) against rollers 303 supported by arms secured to the arms 296, 298 causing the arms 296, 298 to be pushed out of the path of the fingers 302 to enable them to pass the ends 300 of arms 296, 298 freely and thereby complete the folding of the edge flaps 264 to firmly engage the side panels 228 and 230 to be secured thereto by means of the glue which has been applied to predetermined areas of the blank in its initial position above the forming shafts 273, 275 according to FIG. 22.

The operation of the fingers 302 and the associated fingers 304 (see FIG. 29) of the bottom parts 272*a* and 274*a* of the plungers are substantially the same as described in connection with corresponding details of the first embodiment of the machine shown in FIGS. 3 to 11, and move specifically as shown in FIGS. 9 and 11.

At the same time as the blank 200 is moved from its initial position in FIG. 23 and downwardly into the hollow shafts 273, 275 which shafts are separated merely by the movable support plate 284 (see FIG. 13), the blank cooperates with a number of stationary cam surfaces 306 (FIG. 29) and folding plates 308, 309, 310, 311 (FIG. 29) located at the top of the two shafts 273, 275, to erect the side panels of the tray part and the lid part of the carton. Since these folding members are of known design, a detailed description is omitted as far as they are known.

From FIGS. 16–18 it will be understood that when the blank 200 is in its initial position as also shown in FIGS. 22 and 23, there is a hook-shaped tab folding finger 312 located at opposite sides of the blank and in a position to engage the adjacent tabs 236, 236. Each finger 312 has a generally transverse horizontal long arm portion 314 and a short arm 316 pointing substantially vertically downwardly as will be seen in FIG. 16–21. The location of the fingers 312 relative to the other parts of the machine is shown in FIG. 29.

The two tab folding fingers 312 are supported by two parallel legs 390, 390 secured to a transverse base plate 320 which is slidable along longitudinal shafts 321 (FIG. 14) and driven for effecting a predetermined reciprocating movement in a horizontal plane to thereby move the fingers 312 between a forward most end position, shown in FIGS. 16, 17, 19, 20 and 29 and a rearward most end position shown in FIGS. 18 and 21.

Referring again to FIGS. 16–18, when the blank is pressed downwardly from its initial position shown in FIGS. 16 and 22 to its intermediate position shown in FIGS. 17 and 23, the tabs 236, 236 will be folded upwardly by engagement with curved end portions of the long arms 314 of the tab folding fingers as shown in FIG. 17. At the same time the tabs 218 and 238 will be folded upwardly by respective engagement with stationary cam surfaces 306 and 311 (FIGS. 20 and 29).

The head 280 of the plunger is now standing still and the pairs of links 276, 278 are rotated to drive the bottom ends of the plungers 272, 274 along their respective circular arcs for folding the blank over the edge 234 of the support plate 282. An intermediate stage of this operation is shown in FIG. 19 in which the tab 236 has been folded to a position substantially at a right angle relative to side panel 224. When the plungers 272, 274 are in the position shown in FIG. 25, the tab 236 is held by the short downwardly extending arm 316 of the tab folding finger 312 and the side panel 230 has been folded somewhat upwardly by the adjacent sidewall of hollow shaft 275 (see FIG. 13) to a position where it locks the tab 236 in the position shown in FIGS. 18 and 21.

From FIGS. 19–21 and FIG. 29, it will be seen that the L-shaped arms 298 which move together with the plungers 272, 274 are provided with longitudinal rods 322, 324 having abutment heads 326 and 328 respectively, which in the example shown are adjustable nuts so that the distance between the nuts is adjustable to engage the side panel 210 and the hinge panel 232 when the blank has been double folded over the edge 234 of the suppport plate and the support plate has been moved down to its rest position (FIG. 25) below the stationary bottom supports 294, 296 (FIG. 13). The abutment heads 326, 328 engage the double folded portion of the blank in close proximity to the fold line 268 (see FIG. 12) in order to enable an accurate folding of the tabs 220 and 240 by means of the tab folding finger 312 when the plate 320 is retracted and the folding fingers 312 thus are moved from their forward most end position (FIGS. 18, 20) to their rearward most end position (FIG. 21). At the same time the side panel 216 is folded upwardly by engagement with the side wall members of the respective hollow forming shaft to lock the tab 220 in its position shown in FIG. 21. Thereafter, the blank is pressed further down in the two shafts 273, 275 to fully erect all of the side panels and to hold the bottom part 208 and the lid part 222 (see FIG. 12) against the stationary bottom supports 294, 296 (see FIG. 13) when the edge flaps 260, 264 are folded inwardly and glued as described in connection with FIGS. 26–28. Thereafter, the front wall 330 of the hollow shaft 296 is moved from the closed position 330' shown in dotted lines in FIG. 13. To this end, the wall 330 is mounted to arms 332 pivoted at 332a and which are driven in synchronism with the movable parts of the machine.

Conveyor chains 334, 334 with upright pusher pins 336, 336 (FIG. 29) arranged at spaced intervals along chains 334, 334 are moved in stepwise fashion, a predetermined distance to move the erected carton out of the hollow forming shafts 273, 275.

The detailed construction of the two plungers 272, 274 will be best understood from FIGS. 29, 13 and 15. The shaft 281 is reciprocated between upper and lower end positions at predetermined intervals and has a resting interval in the position shown in FIGS. 23 and 24. To the head 280 are secured two casings 338, 340. In each casing is rotatably mounted a lower gear wheel 341 and an upper gear wheel 342 which are drivingly connected through an intermediate gear wheel 344 to effect the same direction of rotation of the two gear wheels 341, 342 secured to shafts 346 and 348 rotatably mounted in the respective casing 340 and 338.

The two shafts 346 extend outwardly from one side of their respective casing and are each provided with a toothed wheel 350 and 352 respectively, (FIGS. 13 and 29) which mesh with one another to synchronize the rotation of the gear wheels in the two casings. A reciprocating control link 394 is secured in an eccentric manner at its lower end to the wheel 352 by pivot pin 394a and is secured at its upper end to a control member (not shown) which controls the reciprocal movement of the link.

The two shafts 346 and 348 in each casing 338 and 340, extend in the opposite direction beyond the opposite sidewall of the respective casing and have circular discs 354, 356 mounted with their center openings (not shown) receiving shafts 346 and 348. A pin is mounted on each disc 346 and 348 at a position along the face of each disc. These axial pins 358 and 360 are each displaced from the centers of the discs 354 and 356 respectively. The pins 358 and 360 are each mounted within bearings 362 carried by vertical plates 364 and 366 respectively (FIGS. 13 and 15). The eccentric radius (i.e. displacement of axial pins 358 and 360 from the center of discs 354 and 356) for the plate 366, as will be understood from FIG. 13, in which the plungers 272 and 274 are at the same level in their upper end position (solid lines) but are ultimately located at different levels in their lowermost position (dotted lines of FIG. 13).

The plate 364 carries the plunger assembly 272 and the plate 366 carries the plunger assembly 274.

Since the detailed design of the two plungers are similar, only the forward plunger 272 will be described in detail hereinbelow.

The plunger 272 (FIGS. 13 and 15) comprises a bottom plate **272*a* and a top plate 368 secured to the vertical plate 364. The plates 272*a* and 368 are connected by means of four vertical rods 370, 372, 274 and 376 (see also FIG. 29). In opposite side edges of the plate 368 are slots 378 for receiving the upper ends of the two arms 296 and 298 pivotally mounted on pins 380 and 382 (see FIG. 15). The arms 296 and 298 are held in their outer positions by means of spring 384 extending between rods 398 and bottom plate 272*a* (FIGS. 15 and 29**).

Figure 7:
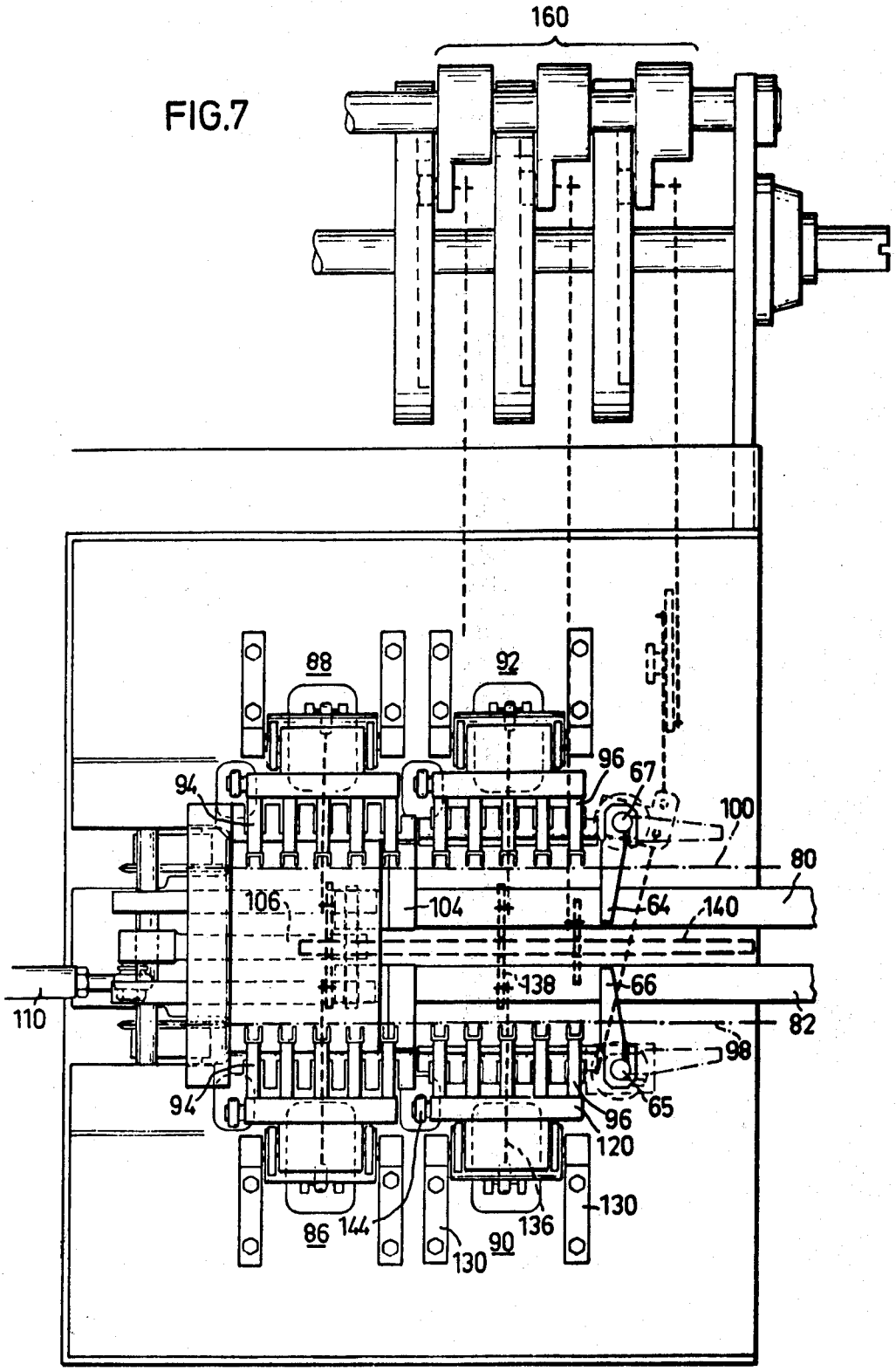
FIG. 7 is a top plan view of the main parts of the machine with certain details omitted for the sake of clarity.

At each side, the bottom plate **272*a* is provided with three transversely extending fingers 304 spaced apart from one another so that the folding fingers 302 may pass freely between te spaced fingers 304 as described in connection with the first embodiment of the machine (FIG. 7**).

As will be understood from the above, the machine in FIG. 29 will enable an accurate erection of blanks shown in FIG. 12, even when the side panels of the bottom part and lid part of the carton are relatively short.

What is claimed is:

1. Apparatus for erecting a carton from a carton blank having a tray portion comprised of a tray bottom and four hingedly connected side panels surrounding said tray bottom and a lid portion having a lid bottom and four hingedly connected side panels surrounding said lid bottom and a common panel section hingedly connected to one tray portion side panel and one lid portion side panel said apparatus comprising:

receiving means for receiving the blank;

means for supporting the hinged connection between the common panel section and the said one tray portion side panel and being movable within said receiving means;

reciprocating means positioned above said receiving means and movable in first and second opposing directions respectively towards and away from said supporting means;

a plunger assembly comprised of plunger halves each having blank engaging surfaces positioned on opposite sides of said supporting means;

means for swingably mounting said plunger halves to said reciprocating means so that the blank engaging surfaces are always maintained substantially parallel to one another;

means movable in a first direction for swinging said carton blank engaging surfaces downwardly and towards said supporting means while maintaining their parallel relationship whereby said surfaces initially respectively engage the tray and lid bottoms and the adjacent ends of said surfaces and engage the common panel section and the tray portion side panel hingedly connected thereto and move said common panel section and said hingedly connected tray side panel towards one another.

2. The apparatus of claim 1 further comprising means for lowering said supporting means to move said supporting means out of the region between the common panel section and the tray portion side panel hingedly connected thereto;

said plunger halves each having portions extending towards the other plunger half, said portions defining said edges which are adapted to press the common panel section and the hingedly connected tray portion side panel into firm engagement after said supporting means has been lowered.

3. The apparatus of claim 2 further comprising:

said receiving means being positioned below said plunger means and having a recess defined by sidewalls which define an opening whose periphery conforms to the periphery of the tray bottom and lid bottom;

said blank being moved into said recess as said reciprocating means moves in said first direction to cause said tray and lid portion side panels to be erected to an upright position.

4. The apparatus of claim 3 wherein said blank is further comprised of end flaps hingedly connected to the side panels parallel to said common panel section, said apparatus further comprising means adjacent said recess opening for folding said end flaps to an upright position as said blank moves towards said recess opening whereby said sidewalls swing the folded end flaps towards the interior surfaces of the side panels arranged transverse to said common panel section.

5. The apparatus of claim 4 further comprising edge flap folding means for folding the marginal ends of the side panels arranged transverse to said common panel section downwardly and inwardly against their associated side panels to capture the associated end flaps therebetween.

6. The apparatus of claim 5 wherein said plunger halves are further provided with swingably mounted downwardly depending arms, biasing means urging the bottom ends of said arms towards the sidewalls of said recess to maintain said side panels upright as their marginal edges are folded downwardly and inwardly.

7. The apparatus of claim 6 further comprising projections mounted on said swingable arms and extending towards said recess sidewalls, said projections being engaged by said flap folding means during the folding of said marginal ends to move said swingable arms away from said sidewalls to move the said bottom ends inwardly and away from said recess sidewalls as the edge flap folding means completes its folding operation.

8. The apparatus of claim 5 further comprising means for applying a bonding medium to selected ones of said side panels to permanently join said marginal edges to their associated side panels.

9. The apparatus of claim 3 wherein said carton blank is further provided with first and second end flaps hingedly connected to the ends of said common panel section and third and fourth end flaps hingedly connected to the ends of the tray portion side panel hingedly connected to said common panel section, said first and third and said second and fourth end flaps being hingedly connected along a line colinear with the hinged connection between said common panel section and the associated tray portion side panel;

said apparatus further comprising first and second folding fingers positioned on opposite sides of said recess and movable between first and second end positions;

means for simultaneously moving said folding fingers in a first direction when said carton blank is positioned upon said receiving means for folding said first and third and said second and fourth end flaps towards said tray bottom whereby said first and third and said second and fourth folded end flaps engage associated tray portion side panels aligned transverse to the common panel section as these side panels are moved in to the upright position by the receiving means sidewalls.

10. The apparatus of claim 9 wherein said carton blank is further provided with fifth and sixth end flaps hingedly connected to the ends of the lid portion side panel which is hingedly connected to said common panel section;

means for moving said folding fingers in said second direction towards said first position whereby said fifth and sixth end flaps are moved into the upright position just before said blank enters said recess whereby said first and second and said third and fourth end flaps are subsequently folded towards said tray bottom after folding of said fifth and sixth end flaps.

* * * * *